US011149957B2

(12) United States Patent
Sloyer

(10) Patent No.: US 11,149,957 B2
(45) Date of Patent: Oct. 19, 2021

(54) COOKING VESSEL SUPPORT GRATE

(71) Applicant: Hestan Commercial Corporation, Anaheim, CA (US)

(72) Inventor: Jairad Sloyer, Rancho Santa Margarita, CA (US)

(73) Assignee: Hestan Commercial Corporation, Anaheim, CA (US)

( * ) Notice: Subject to any disclaimer, the term of this patent is extended or adjusted under 35 U.S.C. 154(b) by 88 days.

(21) Appl. No.: 16/224,074

(22) Filed: Dec. 18, 2018

(65) Prior Publication Data

US 2019/0226684 A1 Jul. 25, 2019

Related U.S. Application Data

(60) Provisional application No. 62/607,146, filed on Dec. 18, 2017.

(51) Int. Cl.
*F24C 15/10* (2006.01)
*F23H 17/08* (2006.01)

(52) U.S. Cl.
CPC ..... *F24C 15/107* (2013.01); *F23H 17/08* (2013.01)

(58) Field of Classification Search
CPC ..... F24C 15/107; F23H 17/08; F23H 2900/17002; A47B 91/00; A47B 91/04; A47B 91/06; A47B 91/12; Y10T 16/209; Y10T 16/21
See application file for complete search history.

(56) References Cited

U.S. PATENT DOCUMENTS 61,282 A * 1/1867 Torrey ..... A47C 7/002 248/188.9
630,128 A * 8/1899 Stock ..... A47B 91/04 248/188.9
771,679 A * 10/1904 Stock ..... A47B 91/04 248/188.9
780,684 A * 1/1905 Pratt ..... A47B 91/04 248/188.9
1,155,269 A * 9/1915 Petersen ..... A47C 7/002 248/188.9

(Continued)

FOREIGN PATENT DOCUMENTS

CA 181465 6/2019
EP 2657614 A1 10/2013
JP 2004150670 A * 5/2004

OTHER PUBLICATIONS

Examiner's Report dated Nov. 5, 2020 issued in connection with corresponding Canadian Patent Application No. 3027906.

*Primary Examiner* — Jorge A Pereiro
(74) *Attorney, Agent, or Firm* — Akerman LLP

(57) ABSTRACT

According to one example, a cooking vessel support grate includes a grate with at least two downward extending legs, with each leg having a lower surface. The cooking vessel support grate further includes an upward extending cavity disposed on the lower surface of each of the legs, and an elastic member attached to each of the legs. The elastic member has an upper portion that at least partially fills the cavity of the respective leg. The elastic member further has a lower portion that projects downward from the lower surface of the respective leg and that covers the surface area of the lower surface of the respective leg.

2 Claims, 8 Drawing Sheets

(56) References Cited

U.S. PATENT DOCUMENTS 1,263,974 A * 4/1918 Whidden ..... A47B 91/06 16/42 R
1,604,293 A * 10/1926 Lehmann ..... A47B 91/06 16/42 R
1,899,699 A * 2/1933 Kusterle ..... A47B 91/06 248/188.8
2,807,042 A * 9/1957 Cramer ..... A47C 7/002 16/42 R
2,973,546 A * 3/1961 Roche ..... B60B 33/0002 16/43
3,080,601 A * 3/1963 Kramcsak, Jr. ..... A47B 91/06 16/42 R
3,173,168 A * 3/1965 Nordmark et al. .... A47B 91/06 16/42 R
3,191,212 A * 6/1965 Hahn ..... A47B 91/066 16/42 R
3,210,035 A * 10/1965 Vincens ..... A47B 47/02 248/188.8
3,640,496 A * 2/1972 Duncan ..... A47B 91/12 248/188.9
3,730,109 A * 5/1973 Kreizel ..... A47B 3/12 108/156
5,287,595 A * 2/1994 Stevens, Jr. ..... A47B 91/06 16/42 T
6,354,231 B1 * 3/2002 Morris ..... A47B 91/028 108/144.11
D489,933 S 5/2004 Rummel et al.
D495,924 S 9/2004 Becker et al.
D554,945 S 11/2007 Chung
D564,838 S 3/2008 Shin et al.
D572,507 S * 7/2008 Eul ..... D6/709
D577,255 S 9/2008 Baldwin et al.
D589,783 S * 4/2009 Eul ..... D8/374
D616,695 S 6/2010 Grey et al.
D622,543 S 8/2010 Funnell et al.
D655,128 S 3/2012 Kim et al.
D661,178 S * 6/2012 Adams ..... D8/374
D721,538 S 1/2015 Kim et al.
8,985,545 B2 * 3/2015 Chiu ..... H05K 5/0234 248/635
9,428,008 B2 * 8/2016 Carpinella ..... B60B 33/0002
D765,459 S 9/2016 Shoemaker et al.
9,552,798 B2 * 1/2017 Schimmel-Vogel ..... G10C 3/02
D781,096 S 3/2017 Kim et al.
D786,608 S 5/2017 Cho et al.
D798,661 S 10/2017 Shoemaker et al.
D801,749 S 11/2017 Wang et al.
D811,165 S 2/2018 Sadtler
D829,504 S 10/2018 Kim et al.
D835,462 S 12/2018 Kamper et al.
D846,944 S 4/2019 Incukur
D854,367 S 7/2019 Kim et al.
D903,412 S 12/2020 Nilssen et al.
2003/0234331 A1 * 12/2003 O'Leary ..... G02B 27/145 248/346.11
2005/0172448 A1 * 8/2005 Jacobson ..... A47C 7/002 16/42 R
2006/0016949 A1 * 1/2006 Payne ..... A47B 91/00 248/346.01
2007/0089266 A1 * 4/2007 Beshore ..... A47C 7/002 16/42 R
2008/0115778 A1 5/2008 Cadima
2009/0260614 A1 * 10/2009 Scott ..... F24C 15/006 126/1 R
2011/0315835 A1 * 12/2011 Wood ..... F24C 15/107 248/176.1
2012/0012098 A1 * 1/2012 Berr ..... F24C 15/107 126/39 B
2012/0048258 A1 * 3/2012 Sewell ..... F24C 15/107 126/152 A
2013/0161456 A1 * 6/2013 Adams ..... A47B 91/12 248/188.9
2014/0027439 A1 * 1/2014 Bach ..... A21B 1/22 219/412
2015/0308696 A1 * 10/2015 Wang ..... F24C 15/107 126/215
2016/0348706 A1 * 12/2016 Carpinella ..... B60B 33/001
2017/0059178 A1 * 3/2017 Lando ..... A47B 91/04
2019/0195505 A1 6/2019 Sloyer
2020/0060421 A1 * 2/2020 Kusch ..... A47B 91/066

* cited by examiner

COOKING VESSEL SUPPORT GRATE

CROSS-REFERENCE TO RELATED APPLICATIONS

This application claims priority to U.S. Provisional Patent Application No. 62/607,146 filed on Dec. 18, 2017, the entirety of which is incorporated herein by reference.

TECHNICAL FIELD

This disclosure relates generally to the field of cooking and more specifically to a cooking vessel support grate.

BACKGROUND

Traditionally, one or more grates may be positioned over gas burners of a cooking range. These grates may support a cooking vessel (e.g., a cooking pot) over the flame emitted by the gas burners. The grates may be removable from the cooking range, allowing a user to clean spilled food, spatter, and debris off of the cooking range (e.g., off of a pan positioned on the cooking range). These traditional grates, however, may be deficient.

SUMMARY

In a first example, a cooking vessel support grate comprises: a grate with four downward extending legs positioned on opposing corners of the grate, each leg having a lower surface; an upward extending cavity disposed on the lower surface of each of the legs, the upward extending cavity having a non-circular cavity region that extends upward from the lower surface of the respective leg, the upward extending cavity further having an upper cavity region that extends upward from the non-circular cavity region of the respective leg; and an elastic member attached to each of the legs, the elastic member having an upper portion that at least partially fills the cavity of the respective leg, the elastic member further having a lower portion that projects downward from the lower surface of the respective leg and that covers the surface area of the lower surface of the respective leg, the upper portion of the elastic member having a non-circular elastic member region that extends upward from the lower portion of the elastic member, the non-circular elastic member region being shaped to substantially fill the non-circular cavity region of the respective leg to preclude lateral rotation of the elastic member within the cavity of the respective leg, the upper portion of the elastic member further having an upper elastic member region that extends upward from the non-circular elastic member region, the upper elastic member region being shaped to at least partially fill the upper cavity region of the respective leg.

In a second example, a cooking vessel support grate comprises: a grate with at least two downward extending legs, each leg having a lower surface; an upward extending cavity disposed on the lower surface of each of the legs; and an elastic member attached to each of the legs, the elastic member having an upper portion that at least partially fills the cavity of the respective leg, the elastic member further having a lower portion that projects downward from the lower surface of the respective leg and that covers the surface area of the lower surface of the respective leg.

Another example includes any such cooking vessel support grate, wherein the at least two downward extending legs comprises four downward extending legs positioned on opposing corners of the grate.

Another example includes any such cooking vessel support grate, wherein the at least two downward extending legs comprises two downward extending legs positioned on opposing sides of the grate, each leg extending across the lateral expanse of the grate.

Another example includes any such cooking vessel support grate, further comprising an adhesive that bonds the upper portion of the elastic member to the cavity of the respective leg.

Another example includes any such cooking vessel support grate, wherein: the upward extending cavity has a non-circular cavity region that extends upward from the lower surface of the respective leg; and the upper portion of the elastic member has a non-circular elastic member region that extends upward from the lower portion of the elastic member, the non-circular elastic member region being shaped to substantially fill the non-circular cavity region of the respective leg to preclude lateral rotation of the elastic member within the cavity of the respective leg.

Another example includes any such cooking vessel support grate, wherein: the upward extending cavity further has an upper cavity region that extends upward from the non-circular cavity region of the respective leg; and the upper portion of the elastic member further has an upper elastic member region that extends upward from the non-circular elastic member region, the upper elastic member region being shaped to at least partially fill the upper cavity region of the respective leg.

Another example includes any such cooking vessel support grate, wherein the upper elastic member region of the elastic member has circular symmetry.

Another example includes any such cooking vessel support grate, further comprising an adhesive that bonds the upper portion of the elastic member to the cavity of the respective leg, wherein the adhesive fills a space in-between a horizontal outer surface of the upper elastic member region and a horizontal inner wall of the upper cavity region of the respective leg.

Another example includes any such cooking vessel support grate, wherein: the upward extending cavity further has a top cavity region that extends upward from the upper cavity region of the respective leg and also extends upward from the upper elastic member region of the elastic member of the respective leg; and the top cavity region is filled with an adhesive that bonds the upper portion of the elastic member to the cavity of the respective leg.

Another example includes any such cooking vessel support grate, wherein: the adhesive further fills a space in-between a horizontal outer surface of the upper elastic member region and a horizontal inner wall of the upper cavity region of the respective leg; and the adhesive extends within the cavity no further than the non-circular cavity region of the respective leg.

In a third example, a method comprises: providing a grate that has at least two downward extending legs, each leg having a lower surface, the grate further having an upward extending cavity disposed on the lower surface of each of the legs, the upward extending cavity having a non-circular cavity region that extends upward from the lower surface of the respective leg, the upward extending cavity further having an upper cavity region that extends upward from the non-circular cavity region of the respective leg; and attaching an elastic member to each of the legs, the elastic member having an upper portion that at least partially fills the cavity of the respective leg, the elastic member further having a lower portion that projects downward from the lower surface of the respective leg and that covers the surface area of the lower surface of the respective leg, the upper portion of the elastic member having a non-circular elastic member region that extends upward from the lower portion of the elastic member, the non-circular elastic member region being shaped to substantially fill the non-circular cavity region of the respective leg to preclude lateral rotation of the elastic member within the cavity of the respective leg, the upper portion of the elastic member further having an upper elastic member region that extends upward from the non-circular elastic member region, the upper elastic member region being shaped to at least partially fill the upper cavity region of the respective leg.

Another example includes any such method, wherein the at least two downward extending legs comprises four downward extending legs positioned on opposing corners of the grate.

Another example includes any such method, wherein the at least two downward extending legs comprises two downward extending legs positioned on opposing sides of the grate, each leg extending across the lateral expanse of the grate.

Another example includes any such method, wherein attaching the elastic member to each of the legs comprises positioning the upper portion of the elastic member into the cavity of each of the legs.

Another example includes any such method, wherein attaching the elastic member to each of the legs comprises positioning adhesive into the cavity of each of the legs, and then positioning the upper portion of the elastic member into the cavity of each of the legs.

Another example includes any such method, wherein: the upward extending cavity has a non-circular cavity region that extends upward from the lower surface of the respective leg; and the upper portion of the elastic member has a non-circular elastic member region that extends upward from the lower portion of the elastic member, the non-circular elastic member region being shaped to substantially fill the non-circular cavity region of the respective leg to preclude lateral rotation of the elastic member within the cavity of the respective leg.

Another example includes any such method, wherein: the upward extending cavity further has an upper cavity region that extends upward from the non-circular cavity region of the respective leg; and the upper portion of the elastic member further has an upper elastic member region that extends upward from the non-circular elastic member region, the upper elastic member region being shaped to at least partially fill the upper cavity region of the respective leg.

Another example includes any such method, wherein the upper elastic member region of the elastic member has circular symmetry.

In a fourth example, a cooking vessel support grate comprises: a grate with at least two downward extending legs, each leg having a lower surface; an upward extending cavity disposed on the lower surface of each of the legs, the upward extending cavity having a non-circular cavity region that extends upward from the lower surface of the respective leg, the upward extending cavity further having an upper cavity region that extends upward from the non-circular cavity region of the respective leg.

In a fifth example, an elastic member comprises: an upper portion that is configured to at least partially fills a cavity of a respective leg of a cooking vessel support grate; a lower portion that is configured to project downward from a lower surface of the respective leg and that is configured to cover the surface area of the lower surface of the respective leg, the upper portion of the elastic member having a non-circular elastic member region that extends upward from the lower portion of the elastic member, the upper portion of the elastic member further having an upper elastic member region that extends upward from the non-circular elastic member region.

BRIEF DESCRIPTION OF THE FIGURES

For a more complete understanding of the present disclosure and its features and advantages, reference is now made to the following description, taken in conjunction with the accompanying drawings, in which.

DETAILED DESCRIPTION

Figure 1:
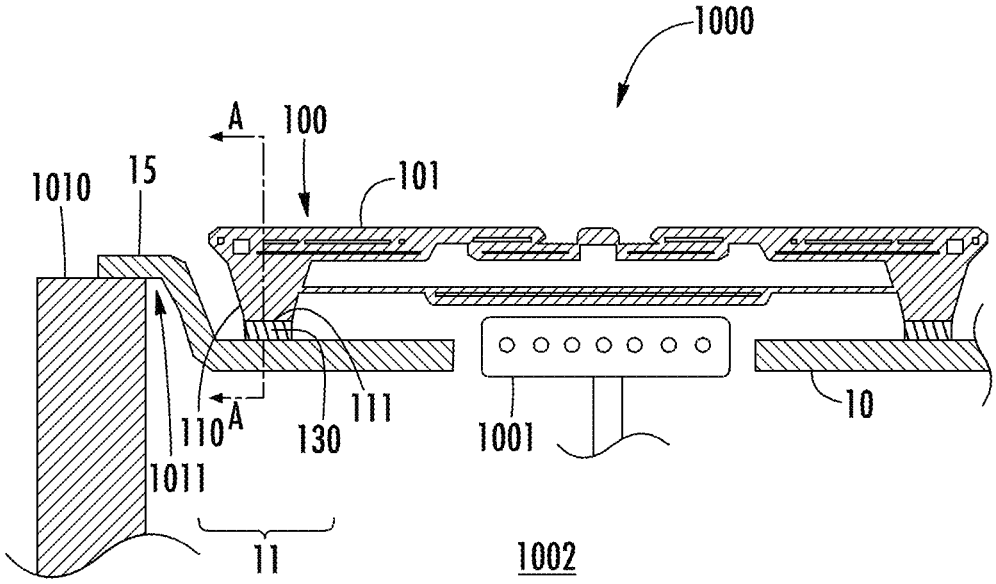
FIG. 1 is a side view of an example cooking range having an example cooking vessel support grate disposed thereon, where components of the cooking range are shown partially in a section view.

Embodiments of the present disclosure are best understood by referring to FIGS. 1-5 of the drawings, like numerals being used for like and corresponding parts of the various drawings.

Traditionally, one or more grates may be positioned over gas burners of a cooking range. These grates may support a cooking vessel (e.g., a cooking pot) over the flame emitted by the gas burners. The grates may be removable from the cooking range, allowing a user to clean spilled food, spatter, and debris off of the cooking range (e.g., off of a pan positioned on the cooking range). These traditional grates, however, may be deficient. For example, these traditional grates may be likely to cause damage to the cooking range. As such, a user may be required to exercise exceptional care when removing and replacing the grates, so as to avoid marring or scratching the pan of the cooking range.

Some traditional grates may utilize rubber or elastic bumpers to absorb the shock of placing heavy pots on the grate, so as to avoid marring the cooking range (e.g., avoid marring the pan positioned on the cooking range). These traditional rubber or elastic bumpers, however, tend to be small. As such, they do not protect the cooking range from scratches or damage when the grate is moved or removed for cleaning the pan of the cooking range, unless the grate is held perfectly horizontal during the movement. Some larger bumpers have been used with these traditional grates. These larger bumpers tend to accidentally catch on surfaces and dislodge from the grate, causing the cooking range to no longer be protected from damage.

Contrary to these traditional grates and bumpers, the cooking vessel support grate 100 of FIGS. 1-4 may address one or more of these deficiencies. For example, the cooking vessel support grate 100 may include an upward extending cavity 120 disposed on the lower surface 111 of each leg 110 of the cooking vessel support grate 100, and may further include an elastic member 130 that is positioned on the lower surface 111 of each leg 110 and that extends upward into the cavity 120 of each leg 110. The elastic member 130 may cover the entire surface area of the lower surface 111 and may provide an elastic cushion to the legs 110 of the cooking vessel support grate 100. This may provide protection to the pan 10 of the cooking range 1000 when the cooking vessel support grate 100 is moved from the cooking range 1000 and replaced back on the cooking range 1000. Additionally, by extending upward into the cavity 120, the elastic member 130 may be more securely bonded to the leg 110, which may prevent accidental dislodgement of the elastic member 130.

FIG. 1 illustrates an example cooking range 1000 having an example cooking vessel support grate 100 disposed thereon. The cooking range 1000 may be any range used for cooking. As an example, the cooking range 1000 may be a gas cooking range 1000. The cooking range 1000 may integrated with an oven, a kitchen appliance that sits on the floor, any other kitchen appliance (e.g., a warming drawer, microwave oven, etc.), any similar cooking equipment, or any combination of the preceding. Alternatively, the cooking range 1000 may be a self-contained unit that fits inside of (and is supported by) an inner rim surrounding an opening or fitted cavity (e.g., a rectangular hole) in a counter or cabinet unit. The oven, appliance, counter, or cabinet unit may be referred to as a support structure 1010 for the cooking range 1000.

The cooking range 1000 may include one or more gas burners 1001 that emit a flame when turned on. The cooking range 1000 may include any number of gas burners 1001. For example, the cooking range 1000 may include 1 gas burner 1001, 2 gas burners 1001, 3 gas burners 1001, 4 gas burners 1001, 5 gas burners 1001, 6 gas burners 1001, or any other number of gas burners 1001.

The cooking range 1000 may further include a pan 10 surrounding the gas burners 1001, causing the gas burners 1001 to be disposed proximal to a bottom portion of the pan 10. The pan 10 may provide a cleanable surface to catch food drippings, food splatters, accidental spills, fluid boiling over from a pot, spilt food, or any combination of the preceding. The pan 10 may be made of stainless steel (e.g., highly polished stainless steel), porcelain, any other cooking material, or any combination of the preceding. The pan 10 may include an upper flange 15 that generally rests on an upper frame of the support structure 1010, and may further include an inner rim 1011 that surrounds an opening (or fitted cavity) 1002 in the support structure 1010.

The cooking range 1000 may also include one or more cooking vessel support grates 100 disposed over and resting on the pan 10. The cooking vessel support grate 100 may be a support structure that supports a cooking vessel (e.g., a cooking pan, a cooking pot, etc.) over one or more of the gas burners 1001, allowing the cooking vessel to be heated by the flames emitted by the gas burners 1001. The cooking vessel support grate 100 may expand over an entire width of the pan 10, allowing it to support cooking vessels over the entire width of the pan 10.

The cooking range 1000 may include any number of cooking vessel support grates 100. For example, the cooking range 1000 may include 1 cooking vessel support grate 100, 2 cooking vessel support grates 100, 3 cooking vessel support grates 100, 4 cooking vessel support grates 100, or any other number of cooking vessel support grates 100. In some examples, the cooking range 1000 may include 1 cooking vessel support grate 100 for each gas burner 1001. In other examples, the cooking range 1000 may include 1 cooking vessel support grate 100 for two (or more) gas burners 1001. In examples where the cooking range 1000 includes multiple cooking vessel support grates 100, the cooking vessel support grates 100 may be positioned adjacent to each other on the pan 10.

Figure 2A:
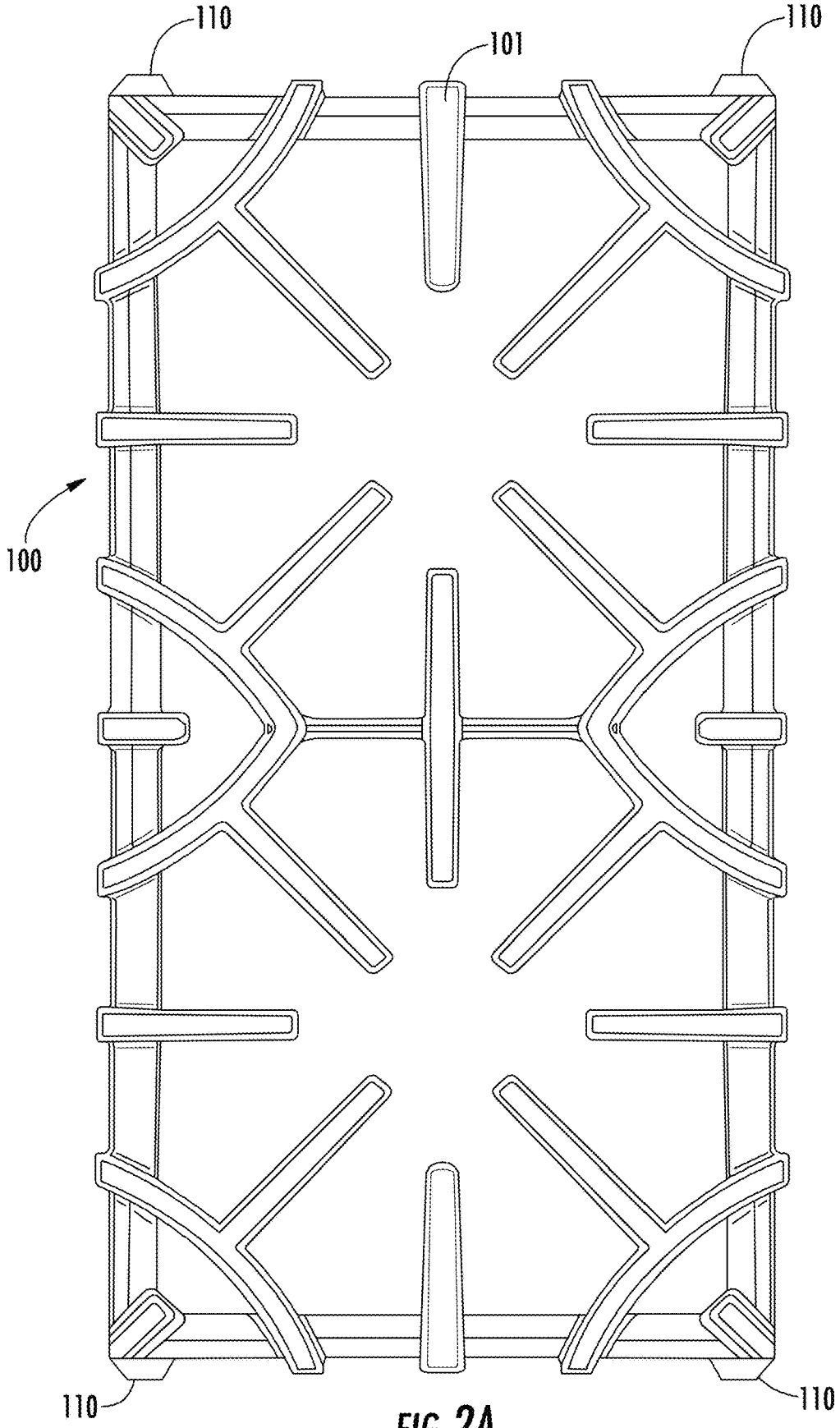
FIG. 2A is a top view of the cooking vessel support grate of FIG. 1.

The cooking vessel support grate 100 may include an upper surface (or plane) 101 that supports the cooking vessel over one or more of the gas burners 1001. The upper surface 101 may be defined by an expanse of interconnected support members, as is illustrated in FIG. 2A (which is a top view of an example cooking vessel support grate 100). The interconnected support members may be shaped in any manner, and connected in any configuration that allows the support members to support one or more cooking vessels. FIG. 2A provides one example of such a shape and configuration.

The cooking vessel support grate 100 may further include two or more legs 110 that extend downward from the upper surface 101 (e.g., extend downward from the interconnected support members that define the upper surface 101). When the cooking vessel support grate 100 is positioned on the cooking range 1000, the downward extending legs 110 may rest indirectly on the pan 10, holding the upper surface 101 a desired distance above pan 10 and/or the gas burners 1001. The cooking vessel support grate 100 may include any number of legs 110. For example, as is seen in FIG. 2B (which is a bottom view of an example cooking vessel support grate 100), the cooking vessel support grate 100 may include 4 legs 110 (e.g., legs 110*a*-110*b*) positioned on (e.g., at or adjacent) opposing corners of the cooking vessel support grate 100.

Figure 2B:
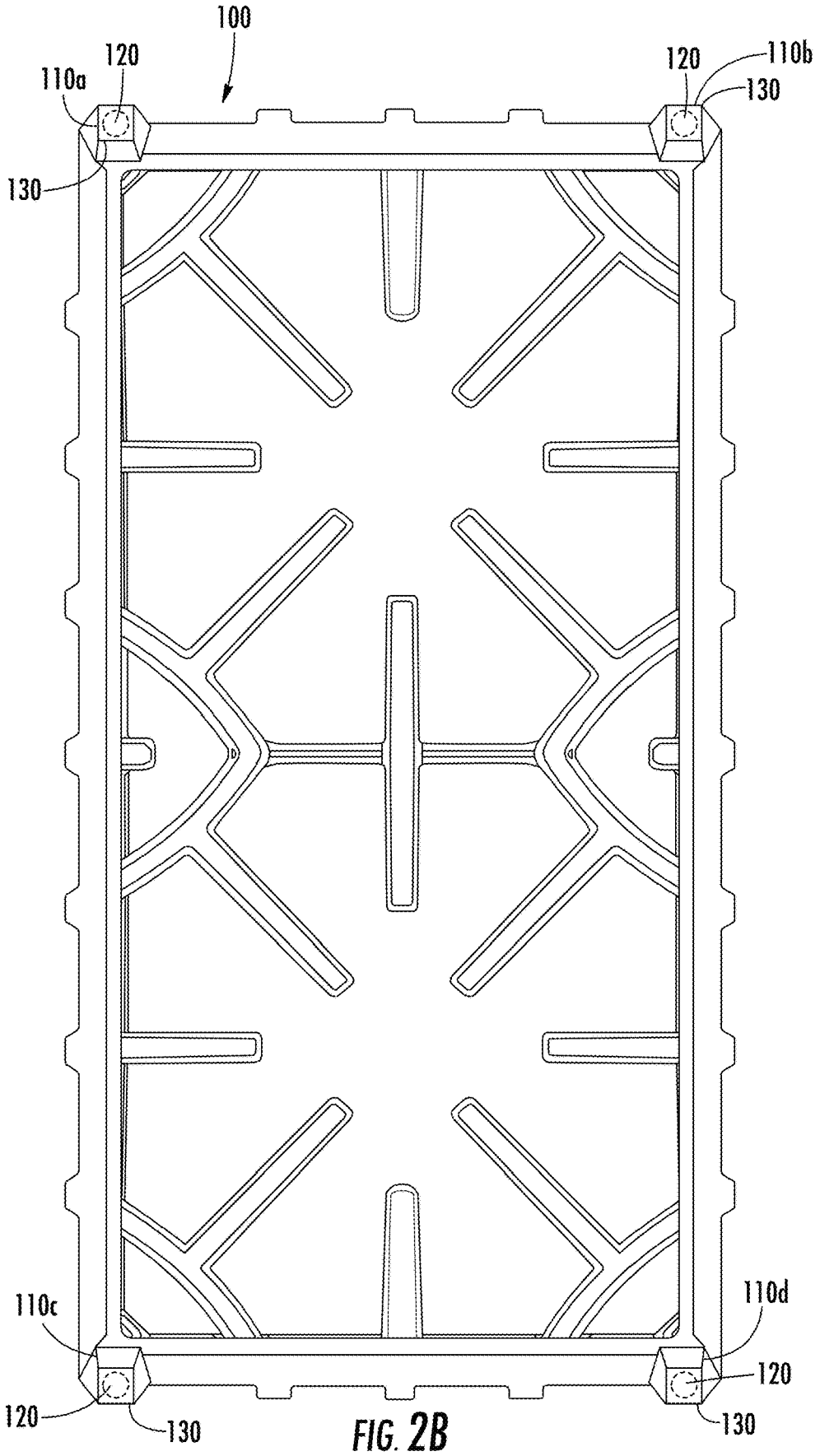
FIG. 2B is a bottom view of the cooking vessel support grate of FIG. 1.

As another example, the cooking vessel support grate 100 may include 6 legs 110, with 4 legs 110 positioned on opposing corners of the cooking vessel support grate 100 (as is seen in FIG. 2B), 1 leg 110 positioned half-way in-between legs 110*a* and 110*c*, and 1 leg 110 positioned half-way in-between legs 110*b* and 110*d*.

Figure 2C:
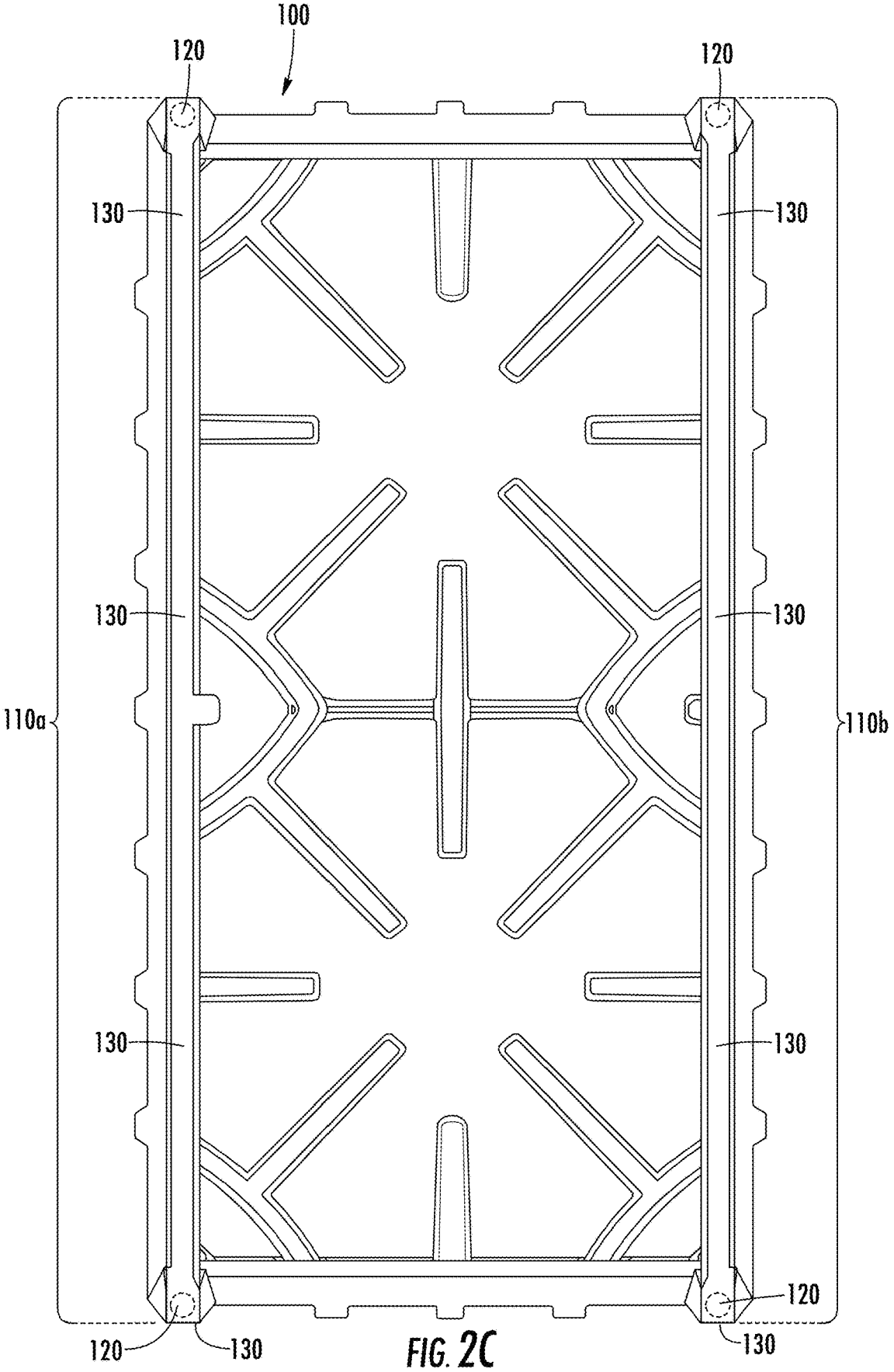
FIG. 2C is a bottom view of another example of a cooking vessel support grate.

As a further example, the cooking vessel support grate 100 may include only 2 legs 110 (e.g., legs 110*a* and 110*b*), as is seen in FIG. 2C. In such an example, leg 110*a* may be positioned on a first side (e.g., the left side) and may extend across the lateral expanse of the cooking vessel support grate 100 (e.g., from the upper corner to the lower corner of the cooking vessel support grate 100 on the left side), and leg 110*b* may be positioned on an opposing side (e.g., the right side) and may extend across the lateral expanse of the cooking vessel support grate 100 (e.g., from the upper corner to the lower corner of the cooking vessel support grate 100 on the right side). In such an example, the legs 110 may be referred to as sides 110. Two such sides 110 may function equivalently to four legs 110, in some examples.

Each leg 110 of the cooking vessel support grate 100 may rest on a peripheral region 11 of the pan 10, as is illustrated in FIG. 1. This peripheral region 11 may define the region adjacent to the periphery of the pan. In other examples, each leg 110 may rest on a rim of the pan 110.

Figure 3A:
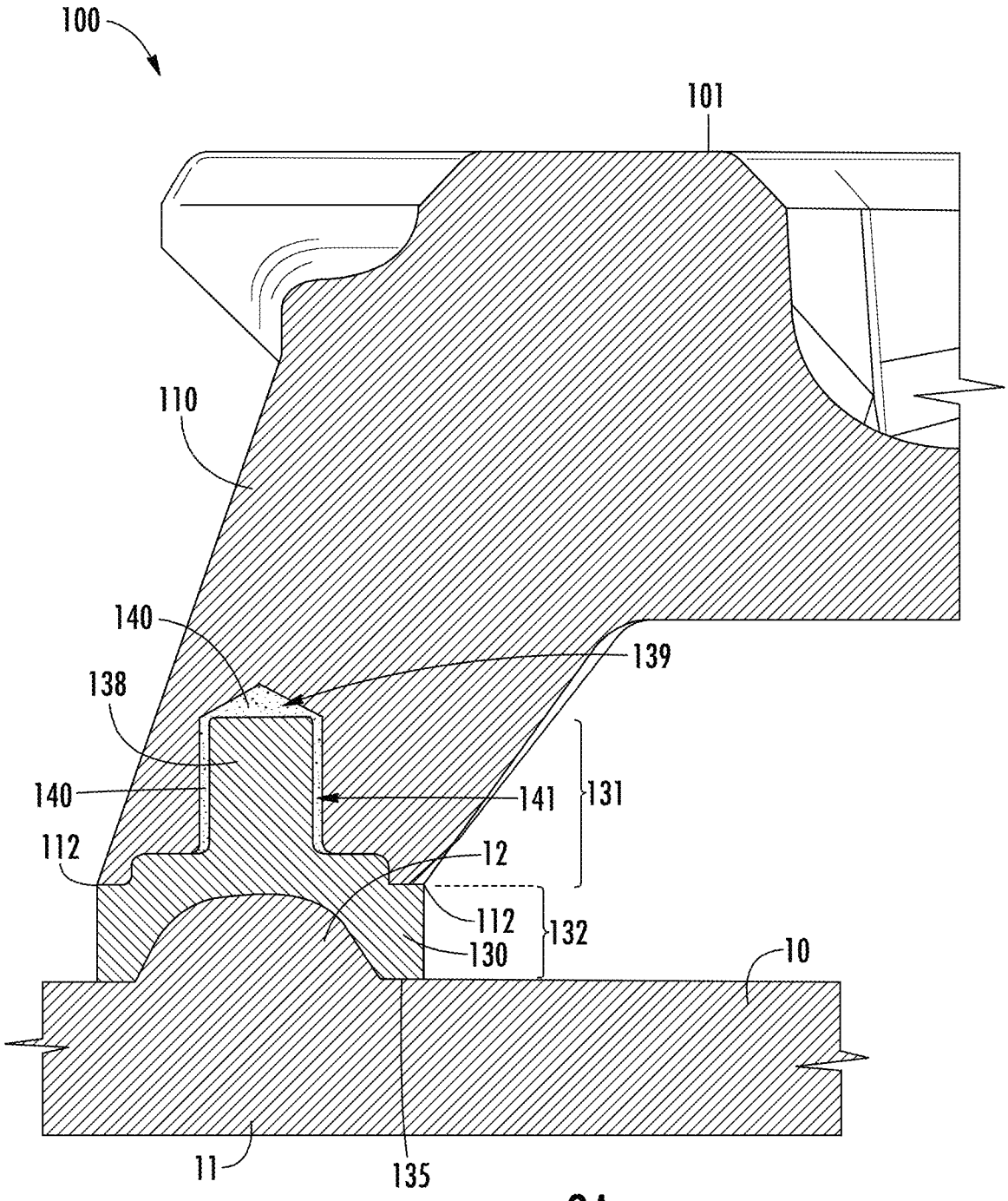
FIG. 3A is a cross-sectional view of the cooking vessel support grate of FIG. 1, taken at section line A-A of FIG. 1.
Figure 3B:
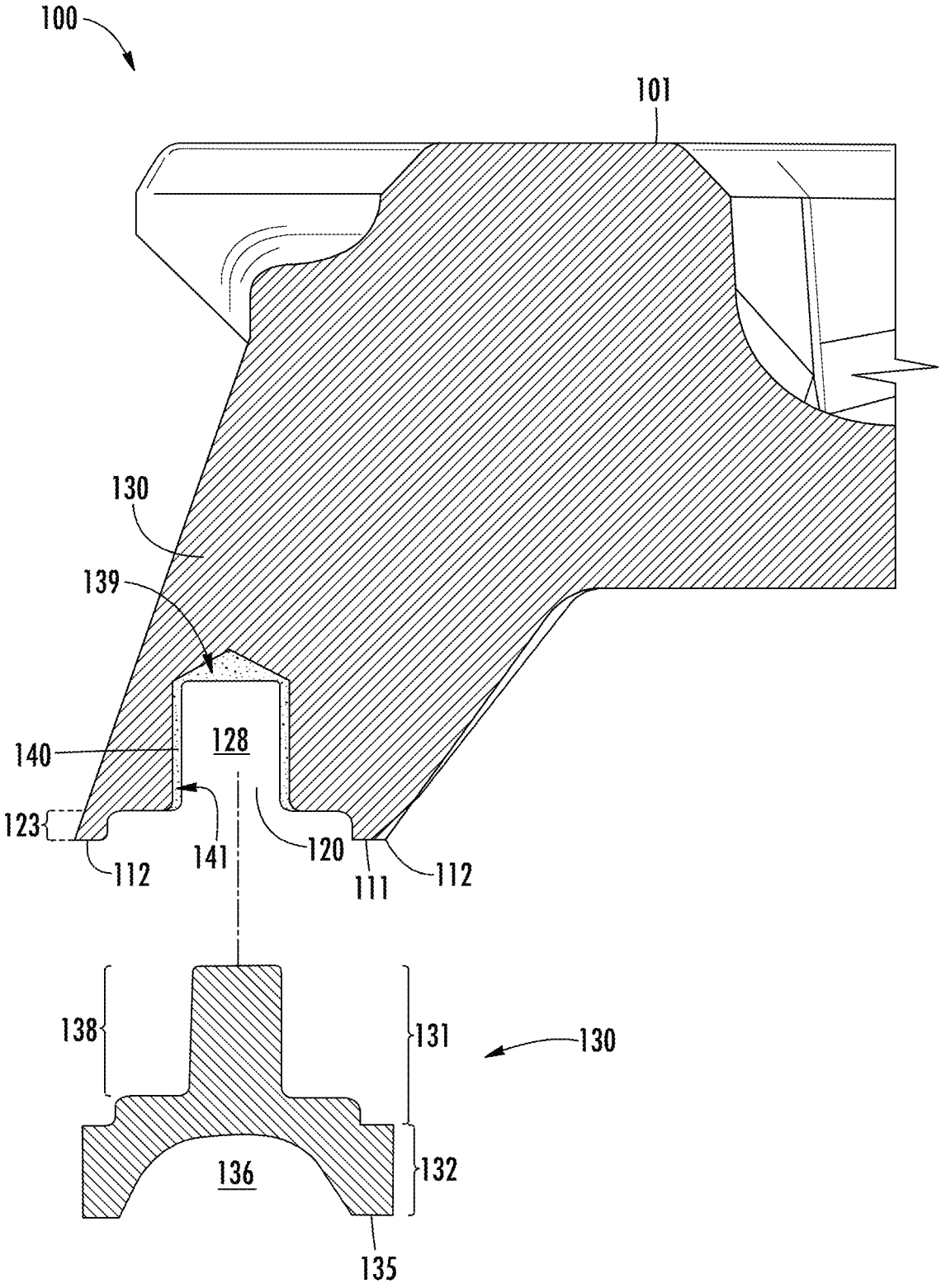
FIG. 3B is a cross sectional view of the cooking vessel support grate of FIG. 1, taken at section line A-A of FIG. 1, before insertion of an example elastic member.

As is illustrated in FIGS. 3A and 3B, each leg 110 may include a cavity 120 disposed on a lower surface 111 of the leg 110. This cavity 120 may extend upward from the lower surface 111 and into the leg 110. Alternatively, if the cooking vessel support grate 100 includes only two legs 110 (e.g., 2 sides 110, as is illustrated in FIG. 2C), each downwardly extending side 110 may include two (or more) cavities 120. Each cavity 120 may receive an upper portion 131 of an elastic member 130, as is discussed below.

As is mentioned above, the cooking vessel support grate 100 may further include an elastic member 130 positioned on the lower surface 111 of each leg 120. The elastic member 130 may be a structure or device that provides an elastic cushion to the legs 120 of the cooking vessel support grate 100. This may, in some examples, provide protection to the pan 10. For example, it may allow a user to more easily remove the cooking vessel support grate 100 from the pan 10 (so as to clean the pan 10 and/or the cooking vessel support grate 100) and more easily replace the cooking vessel support grate 100 on the pan 10 (after the pan 10 and/or the cooking vessel support grate 100 has been cleaned). In such an example, the elastic members 130 may provide a cushion that prevents the legs 110 (or any other portion of the cooking vessel support grate 100, such as the interconnected members that make up the upper surface 101) from accidentally contacting the pan 10 and accidentally scratching, marring, or damaging the pan 10. As such, the cooking vessel support grate 100 may be removed and/or replaced without considerable strength, skill, and/or attention that might otherwise be required to avoid such accidental damage.

As another example, the elastic members 130 may provide a cushion that absorbs the energy and/or weight of a cooking vessel. In such an example, a heavy cooking vessel (e.g., a pot) or a full cooking vessel may be dropped on the cooking vessel support grate 100, and this energy may be absorbed by the elastic members 130, preventing damage to the pan 10 (and/or the surrounding frame and cabinetry) from such an impact.

The elastic members 130 may also extend upward into the cavities 120 (and may also be strongly bonded in multiple regions to the cavities 120) in the legs 110, allowing the elastic members 130 to absorb shocks caused by the moving of heavy pots and pans filled with food stuffs, without being deformed, dislodged or rotated, and further allowing the elastic members 130 to prevent the cooking vessel support grate 100 from slipping and marring the pan 10.

The elastic member 130 may be made of any material that provides a cushion. Furthermore, the elastic member 130 may also be made of any material that both provides a cushion and that also is elastic (i.e., the material resumes its normal shape spontaneously after contraction, dilation, or distortion). In a preferred example, the elastic member 130 may be made of silicone, silicone rubber, fluoridated silicone rubber, fluorosilicone rubber, thermo-set resin (e.g., resin soft enough to not scratch polished or satin finished stainless steel, or ceramic-like porcelain finishes on metal), or any combination of the preceding. In another preferred example, the elastic material 130 may be made of the material SE01770T from Chang Horing Rubber Co., LTD. In some examples, the elastic material 130 may be made of a resilient elastic material. Such a resilient elastic material may be a material (e.g., silicone rubber, fluorosilicone rubber, and the like) that is soft enough not to scratch or mar stainless steel, as well as not compress under the load of the cooking vessel support grate 100, cooking vessels, and their contents so that a portion (e.g., a metal portion) of the cooking vessel support grate 100 would contact the pan 10 (e.g., a stainless steel pan 10). Also, such a resilient elastic material may withstand and not degrade from repeated exposure to heat from cooking such as about 150-200° C. or greater, and not undergo compression set, creep, or tear when subjected to repeated compressive and shear stress of at least about 50% or at anticipated loading of the cooking vessel support grate 100, cooking vessels and their contents.

Figure 4:
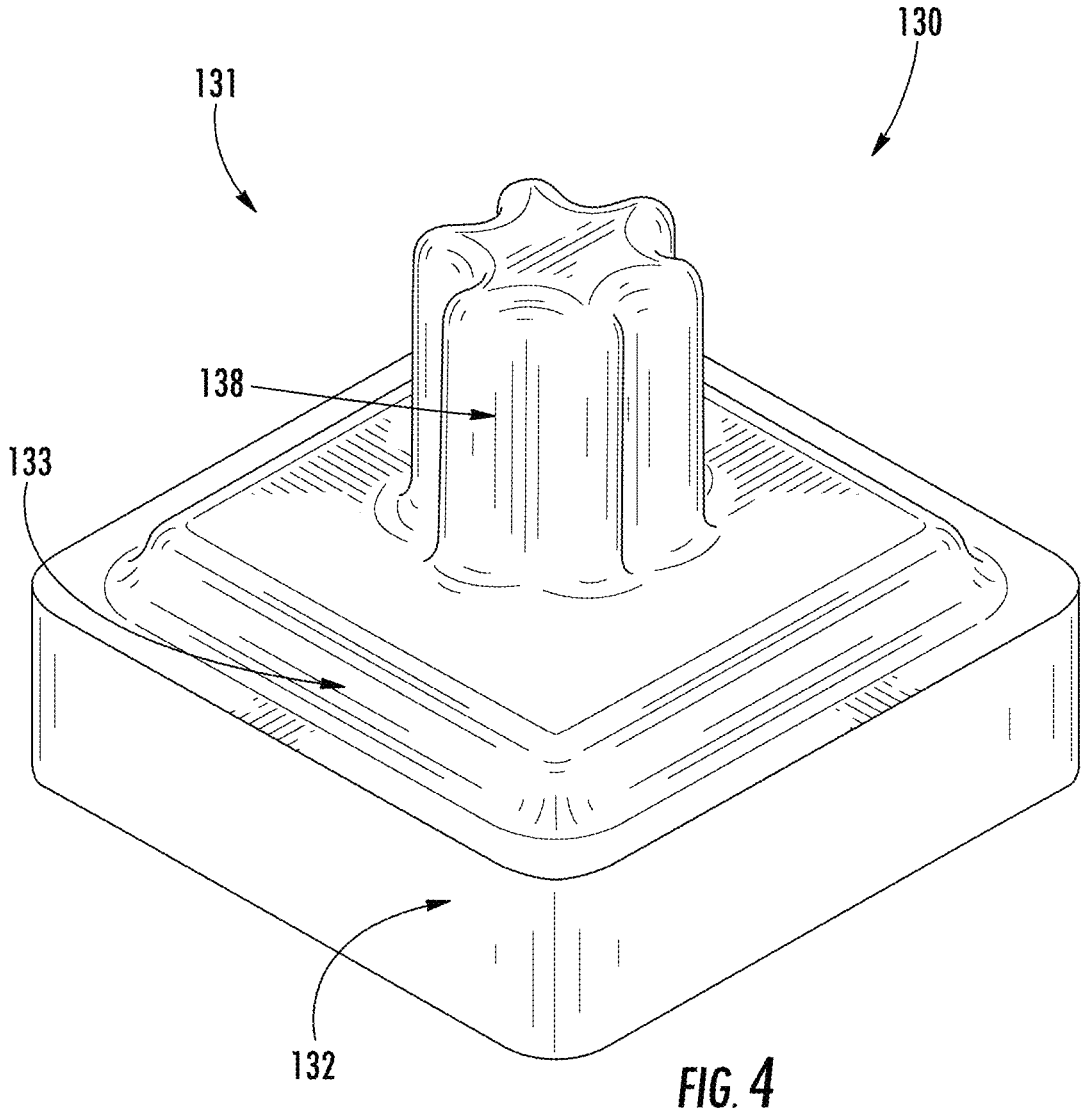
FIG. 4 is a perspective view of an example elastic member of the cooking vessel support grate of FIG. 1.

As is illustrated in FIGS. 3A, 3B, and 4, the elastic member 130 may include an upper portion 131 and lower portion 132. The upper portion 131 may extend upward from the lower portion 132. Furthermore, the upper portion 131 may be shaped to fit within the cavity 120 of leg 110. As such, when the elastic member 130 is attached to a leg 110, the upper portion 131 may extend upward into the cavity 120 so as to at least partially fill the cavity 120. In some examples, the upper portion 131 may fill the cavity 120 entirely. In other examples, the upper portion 131 may fill only a portion of the cavity 120, as is illustrated in FIGS. 3A-3B. The upper portion 131 may have any size and/or shape that allows it to extend upward into the cavity 120 so as to at least partially fill the cavity 120. Preferred examples of the size and/or shape of the upper portion 131 are discussed in detail below.

To hold the upper portion 131 within the cavity 120, the cooking vessel support grate 100 may include an adhesive 140 disposed within the cavity 120. The adhesive 140 may bond the upper portion 131 to the cavity 120 (e.g., it may bond the upper portion 131 to one or more inner walls of the cavity 120), holding the upper portion 131 within the cavity 120. This bond may prevent the elastic member 130 from being removed from the lower surface 111 of the leg 110. The adhesive 140 may be any type of adhesive that may bond the upper portion 131 to cavity 120. In a preferred example, the adhesive 140 may be a liquid adhesive (e.g., glue).

In some examples, the upper portion 131 may be held within the cavity 120 without the use of an adhesive. For example, the upper portion 131 may be designed to hold itself within the cavity 120. As an example of this, a diameter of the upper portion 131 may be slightly larger than a diameter of the cavity 120. In such an example, the larger diameter of the upper portion 131 may create a snug fit with the smaller diameter of the cavity 120, and the friction created by such a snug fit may hold the upper portion 131 within the cavity 120.

The elastic member 130 may further include a lower portion 132 that extends downward from the upper portion 131. When the elastic member 130 is attached to a leg 110, the lower portion 132 may project downward from the lower surface 111 of the leg 110. This downward projection may provide the elastic cushion to the legs 110 of the cooking vessel support grate 100, preventing the lower surface 111 of the legs 110 from touching the pan 10.

The lower portion 132 may have any size and/or shape that allows it to project downward from the lower surface 111 of the leg 110, so as to provide the elastic cushion to the legs 110. In a preferred example, the lower portion 132 may be sized and/or shaped to extend substantially or completely across the full lateral expanse of the leg 110, while also projecting downward from the lower surface 111 of the leg 110. As an example of this, the lower portion 132 may extend laterally (e.g., in orthogonally opposing directions) over the lower surface 111 of the leg 110 so as to substantially or completely cover the surface area of the lower surface 111. FIGS. 3A-3B illustrate one example of this, with the lower portion 132 extending laterally all the way up to edges 112 of the lower surface 111. This may allow the lower portion 132 to extend downward from the edges 112, covering those edges 112, and preventing the edges 112 from scratching, marring, or damaging the pan 10. In some examples, the lower portion 132 may extend laterally beyond the edges 112, so as to further cover the edges 112.

In a cooking vessel support grate 100 that includes only two legs 110 (e.g., 2 sides 110, as is illustrated in FIG. 2C), the lower portion 132 of the elastic member 130 may extend laterally over the entire side 110, so as to substantially or completely cover the surface area of the lower surface 111 of the side 110. In such an example, the lower portion 132 may provide the elastic cushion to the entire side 110. Furthermore, the elastic member 130 may further include 2 (or more) upper portions 131 which extend upward into the 2 (or more) cavities 120 included on each side 110.

The lower portion 132 of the elastic member 130 may further be shaped to provide a more secure connection between the pan 10 and the cooking vessel support grate 100. For example, as is illustrated in FIGS. 3A-3B, the bottom surface 135 of the lower portion 132 of the elastic member 130 may have an upward extending depression 136. This upward extending depression 136 may be shaped and/or sized to mate with a reverse and upward extending protuberance 12 of the pan 10 (e.g., positioned adjacent the pan periphery 11), so as to seat the cooking vessel support grate 100 on the pan 10. This mating may securely connect the pan 10 and the cooking vessel support grate 100, so that when the cooking vessel support grate 100 is properly positioned on the protuberances 12, the cooking vessel support grate 100 is restricted from being moved laterally in relation to the pan 10. This may, in some examples, encourage the user to lift the cooking vessel support grate 100 vertically for removal, and may assist the user in properly replacing the cooking vessel support grate 100 by allowing the user to align the cooking vessel support grate 100 with the protuberances 12 (and the sides of the pan 10). Furthermore, this may allow for a more stable and proper alignment between the cooking vessel support grate 100 and the pan 10. It may also prevent the cooking vessel support grate 100 from being dislodged from its alignment on the pan 10 when full heavy cooking vessels are slid over the cooking vessel support grate 100, in some examples.

FIGS. 3A, 3B, and 4 further illustrate examples of the size and/or shape of cavity 120 and the upper portion 131 of the elastic member 130. As is illustrated in FIG. 3B, the cavity 120 may include a non-circular cavity region (or flange or shelf) 123 that extends upward from the lower surface 111 of the leg 110, and the upper portion 131 of the elastic member 130 may include a non-circular elastic member region 133 that extends upward from the lower portion 132 of the elastic member 130. When the upper portion 131 of the elastic member 130 is inserted into the cavity 120, this non-circular cavity region 123 may engage the non-circular elastic member region 133, so as to prevent the elastic member 130 from rotating laterally (e.g., prevent the elastic member 130 from rotating along a horizontal plane) within the cavity 120 and in relation to the leg 110.

It should be understood that the term "non-circular" refers to a geometric shape that deviates from a perfect geometric circle by a sufficient amount to prevent lateral rotation of the elastic member 130 within the cavity and in relation to the leg 110. Examples of a "non-circular" geometric shape include a square, a rectangle, a diamond, a triangle, a crescent shape, or any of such shapes with minor deviations (e.g., rounded corners, fluting, depressions, etc.). A non-circular geometric shape further includes geometric shapes having circular symmetry, but that also deviate from a perfect geometric circle by a sufficient amount to prevent lateral rotation of the elastic member 130 within the cavity and in relation to the leg 110. For example, non-circular geometric shapes include a circular shape with fluting (e.g., peripheral fluting) or depressions (e.g., concave depressions), a gear shape (e.g., having teeth), or a polygonal shape with fluting or depressions (e.g., forming a gear-like shape). In some examples, if the elastic member 130 is made of a material having a low compressive modulus that can deform under rotary shear, the shape of the non-circular elastic member region 133 may need to deviate further from a perfect geometric circle by a sufficient amount in order to be a "non-circular" geometric shape.

In some examples, the shape of the non-circular cavity region 123 may be complimentary to the shape of the non-circular elastic member region 133. That is, the two shapes may fit together. For example, if the non-circular cavity region 123 of the cavity 120 is shaped as a rectangle or substantially shaped as a rectangle (e.g., a rectangle with minor deviations, such as rounded corners, fluting, etc.), the non-circular elastic member region 133 of the elastic member 130 may be shaped as a slightly smaller rectangle or may be substantially shaped as a slightly smaller rectangle, allowing the non-circular elastic member region 133 to fit within the non-circular cavity region 123. In some examples, the two complimentary shapes may assist in preventing the elastic member 130 from rotating laterally within the cavity 120 and in relation to the leg 110.

In some examples, the shape of the non-circular cavity region 123 may not be entirely complimentary to the shape of the non-circular elastic member region 133. However, in such examples, the two shapes may still be sufficiently complementary to prevent the elastic member 130 from rotating laterally within the cavity 120 and in relation to the leg 110. As an example of this, if the non-circular cavity region 123 of the cavity 120 is shaped as a rectangle, the non-circular elastic member region 133 of the elastic member 130 may also be shaped as a slightly smaller rectangle, but the slightly smaller rectangle may include gaps (or flutes) in its shape (i.e., it may be substantially rectangular). In some examples, this deviation from an entirely complementary shape may allow an adhesive 140 to flow into the gaps (or flutes) in the shape of non-circular elastic member region 133 of the elastic member 130. As such, the adhesive 140 may be able to provide a more secure bond between the elastic member 130 and the inner walls of the cavity 120. In some examples, the shape of the non-circular cavity region 123 may correspondingly conform to the shape of the non-circular elastic member region 133. That is, both the non-circular cavity region 123 and the non-circular elastic member region 133 may have the same non-circular shape, and the strength of the adhesive 140 applied between the cavity 120 and the elastic member 130 may be sufficient to prevent the elastic member 130 from rotating in the cavity 120.

In some examples, the non-circular elastic member region 133 may also be shaped (i.e., shaped and sized) to substantially fill the non-circular cavity region 123. Such a substantial filling may refer to a shape (and size) of the non-circular elastic member region 133 that fills a sufficient amount of the volume of the non-circular cavity region 123 to prevent the elastic member 130 from rotating laterally within the cavity 120 and in relation to the leg 110. For example, such a substantial filling may refer to a shape (and size) of the non-circular elastic member region 133 that fills at least 85% (i.e., 85%-100%) of the volume of the non-circular cavity region 123. As another example, such a substantial filling may also refer to a shape (and size) of the non-circular elastic member region 133 that in combination with the adhesive 140 fills at least 90% (i.e., 90%-100%) of the volume of the non-circular cavity region 123. The substantial filling may, in some examples, allow for gaps to be created between the outside surface of the non-circular elastic member region 133 and the inner walls of the non-circular cavity region 123. The adhesive 140 may fill all or a portion of these gaps, thereby creating a stronger bond between the elastic member 130 and the inner walls of the cavity 120.

As is also illustrated in FIGS. 3A, 3B, and 4, the cavity 120 may also include an upper cavity region 128 that extends upward from the non-circular cavity region 123, and the upper portion 131 of the elastic member 130 may also include an upper elastic member region 138 that extends upward from the non-circular elastic member region 133. When the upper portion 131 of the elastic member 130 is inserted into the cavity 120, this upper elastic member region 138 may extend upward into the upper cavity region 128 of the cavity 120, so as to provide additional surface area for bonding the elastic member 130 to the cavity 120 (e.g., using adhesive 140). Additionally, the upper elastic member region 138 may also distribute stress to prevent the elastic member 130 from being dislodged from the leg 110. In some examples, this may allow the elastic member 130 to be stably attached to the leg 110, even though the elastic member 130 is large enough to prevent damage to the pan 10.

The upper cavity region 128 of the cavity 120 and the upper elastic member region 138 of the elastic member 130 may each have any shape and/or size that allows the upper elastic member region 138 to extend upward into the upper cavity region 128. For example, one or both of the upper cavity region 128 and the upper elastic member region 138 may have a circular shape or a non-circular shape (examples of which are discussed above). As another example, the upper cavity region 128 and the upper elastic member region 138 may have complementary shapes or partially complementary shapes (examples of both of which are also discussed above). As is illustrated in FIG. 4, the upper elastic member region 138 of the elastic member 130 has circular symmetry, but it also includes fluting (e.g., peripheral fluting) that deviates from the circular shape. This fluting may create gaps between the outside surface of the upper elastic member region 138 and the inner sides of the upper cavity region 128.

The upper elastic member region 138 of the elastic member 130 may be shaped (i.e., shaped and sized) to at least partially fill the upper cavity region 128 of the cavity 120. In some examples, the upper elastic member region 138 of the elastic member 130 may be shaped (i.e., shaped and sized) to substantially fill the upper cavity region 128 of the cavity 120. For example, such a substantial filling may refer to a shape (and size) of the upper elastic member region 138 that fills at least 85% (i.e., 85%-100%) of the volume of the upper cavity region 128. As another example, such a substantial filling may also refer to a shape (and size) of the upper elastic member region 138 that in combination with the adhesive 140 fills at least 90% (i.e., 90%-100%) of the volume of the upper cavity region 128. The substantial filling (or the partial filling) may, in some examples, allow for gaps to be created between the outside surface of the upper elastic member region 138 and one or more inner walls (e.g., horizontal inner walls, top vertical wall) of the upper cavity region 128 of the cavity 120. The adhesive 140 may fill all or a portion of these gaps, thereby creating a stronger bond between the elastic member 130 and the inner walls of the cavity 120. In some examples, the upper elastic member region 138 may be shaped (and sized) to receive a sufficient volume of adhesive 140 to bond the elastic member 130 within the cavity 120 and to the leg 110.

As is further illustrated in FIGS. 3A and 3B, the cavity 120 may also include a top cavity region 139 that extends upward from upper cavity region 128 of the cavity 120. Furthermore, when the upper portion 131 of the elastic member 130 is inserted into the cavity 120, this top cavity region 139 may also extend upward from the upper elastic member region 138 of the elastic member 130, as is illustrated in FIG. 3A. The top cavity region 139 may have any size and/or shape. As is illustrated in FIGS. 3A-3B, the top cavity region 139 is conical shaped.

The top cavity region 139 may be filled with the adhesive 140. In some examples, it may be preferable to fill the top cavity region 139 with an amount of adhesive 140 that exceeds the volume of the top cavity region 139. As such, when the upper portion 131 of the elastic member 130 is inserted into the cavity 120, the upper portion 131 may apply pressure to the adhesive 140. To escape this pressure, the adhesive 140 may travel into (and fill) a space (or gap) 141 in-between the horizontal outer surface of the upper elastic member region 138 and a horizontal inner wall of the upper cavity region 128, as is illustrated in FIG. 3A. This space 141 may be the result of a size difference between the upper elastic member region 138 and the upper cavity region 128. This space 141 may also be the result of gaps created by deviations in the shape of the upper elastic member region 138. In some examples it may be preferable to provide this space 141 so as to allow the adhesive 140 to escape downward (via extrusion). By escaping into the space 141, the adhesive 140 may surround the sides of the upper elastic member region 138, creating a stronger bond between the elastic member 130 and the cavity 120.

In some examples, the shape of the elastic member 130 may prevent the adhesive 140 from travelling past the top most surface of the non-circular elastic member region 133 of the elastic member 130. As such, the adhesive 140 may be prevented from extending further downward than the non-circular elastic member region 133 of the elastic member 130. In other examples, the adhesive 140 may travel past the top most surface of the non-circular elastic member region 133 of the elastic member 130. For example, the adhesive may travel into (and fill) gaps created between the outside surface of the non-circular elastic member region 133 and inner walls of the non-circular cavity region 123.

As is discussed above, the cavity 120 and the elastic member 130 may have any size. In some examples, it may be preferable for the total depth (or height) of the cavity 120 to be twice the diameter (or width) of the non-circular cavity region 123, or greater. This total depth (or height) of the cavity 120, however, may be limited by the height of the legs 110. Additionally, in some examples it may also be preferable for the diameter (or width) of the non-circular cavity region 123 to be at least half the diameter (or width) of the leg 110. Such dimensions and proportions may provide for a more secure attachment between the elastic member 130 and the cavity 120. Thus, it may provide for a more optimal durability considering the potential for dislodging the elastic member 130 in normal use over time.

Modifications, additions, and/or substitutions may be made to the cooking vessel support grate 100, the components of the cooking vessel support grate 100, and/or the functions of the cooking vessel support grate 100 without departing from the scope of the specification. For example, the cooking vessel support grate 100 may have any dimensions, may include additional components, and/or may not include one or more of the components discussed above.

Figure 5:
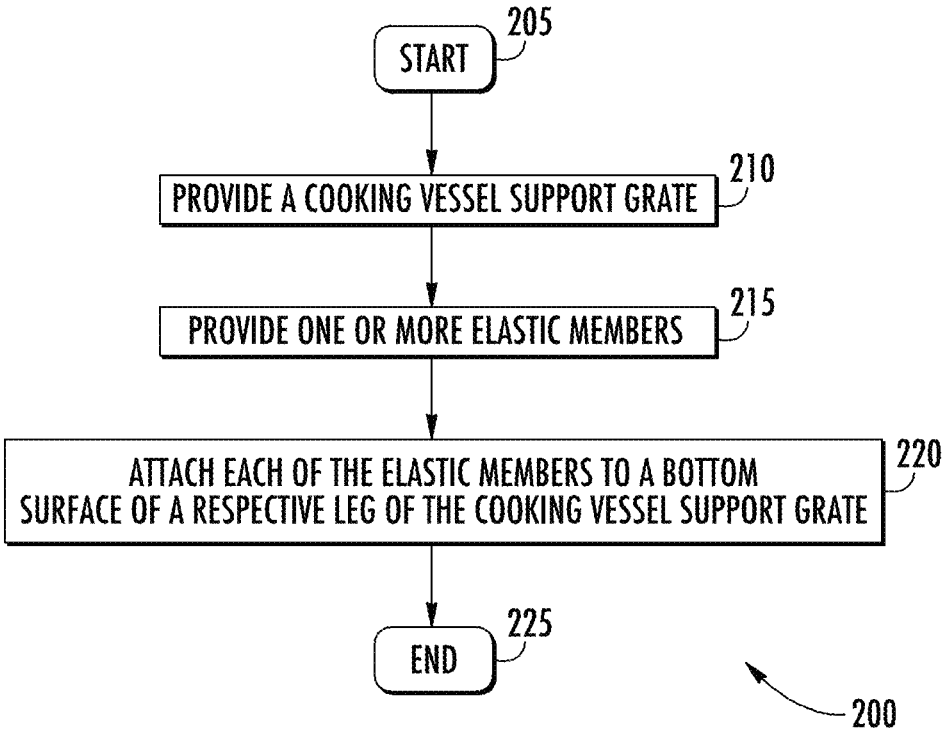
FIG. 5 illustrates one example method of forming a cooking vessel support grate

FIG. 5 illustrates one example method 200 of forming a cooking vessel support grate. One or more of the steps (such as all of the steps) of method 200 may be performed using the cooking vessel support grate 100 of FIGS. 1-4. Furthermore, one or more of the steps (such as all of the steps) of method 200 may be performed by a manufacturer of a cooking vessel support grate, a re-seller of a cooking vessel support grate, a shipper of a cooking vessel support grate, an installer of a cooking vessel support grate, and/or a user of a cooking vessel support grate. Additionally, one or more of the steps of method 200 may be performed by different entities.

The method 200 begins at step 205. At step 210, a cooking vessel support grate 100 may be provided. The cooking vessel support grate 100 may be substantially similar (or identical) to the cooking vessel support grate 100 discussed above with regard to FIGS. 1-4; however, it may not include the elastic members 130. Also, the cooking vessel support grate 100 may be provided in any manner. For example, the cooking vessel support grate 100 may be built, formed, purchased, shipped, acquired, received, provided in any other manner, or any combination of the preceding. In some examples, building or forming the cooking vessel support grate 100 may include drilling (or otherwise adding) one or more cavities 120 into the legs 110 of the cooking vessel support grate 100.

At step 215, one or more elastic members 130 may be provided. The elastic members 130 may be substantially similar (or identical) to the elastic members 130 discussed above with regard to FIGS. 1-4. Any number of the elastic members 130 may be provided. Also, the elastic members 130 may be provided in any manner. For example, the elastic members 130 may be built, formed, purchased, shipped, acquired, received, provided in any other manner, or any combination of the preceding.

At step 220, each of the elastic members 130 may be attached to a bottom surface 111 of a respective leg 110 of the cooking vessel support grate 100. The elastic member 130 may be attached to the bottom surface 111 of the respective leg 110 in any manner. For example, a user (via their hands and/or a device) may position the upper portion 131 of the elastic member 130 into the cavity 120 of the leg 110. As another example, a user (via their hands and/or a device) may first position an amount of adhesive 140 into the cavity 120 of the leg 110, and then the user (via their hands and/or a device) may position the upper portion 131 of the elastic member 130 into the cavity 120 of the leg 110. Following attachment of the elastic members 130 to the bottom surfaces 111 of the legs 110, the method may move to step 225, where the method 200 ends.

Modifications, additions, or omissions may be made to method 200. For example, the method 200 may include one or more additional steps. As an example of this, the method may further include positioning the formed cooking vessel support grate 100 onto a cooking range 1000, such as onto a pan 10 of the cooking range 1000. Furthermore, the method 200 may not include one or more of the steps. As an example of this, the method 200 may only include building or forming the cooking vessel support grate 100 (without the elastic member 130), or may only include building or forming the elastic member(s) 130. Additionally, the steps of method 200 may be performed in parallel or in any suitable order.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, reorganizing, or removing any of the disclosed steps, components, elements, features, aspects, characteristics, limitations, and the like, of the various non-limiting and non-exhaustive embodiments or examples described in this specification.

What is claimed is:

1. A cooking vessel support grate comprising:

a. a grate with at least two downward extending legs, each leg having a lower surface;

b. an upward extending cavity disposed on the lower surface of each of the legs, the upward extending cavity having a non-circular cavity region that extends upward from the lower surface of the respective leg, the upward extending cavity further having an upper cavity region that extends upward from the non-circular cavity region of the respective leg, the upper cavity region having a smaller diameter or width than the non-circular cavity region of the respective leg; and c. an elastic member attached to each of the legs, the elastic member having an upper portion that at least partially fills the cavity of the respective leg, the elastic member further having a lower portion that projects downward from the lower surface of the respective leg and that covers the surface area of the lower surface of the respective leg, the upper portion of the elastic member having a non-circular elastic member region that extends upward from the lower portion of the elastic member, the non-circular elastic member region being shaped to substantially fill the non-circular cavity region of the respective leg to preclude lateral rotation of the elastic member within the cavity of the respective leg, the upper portion of the elastic member further having an upper elastic member region that extends upward from the non-circular elastic member region, the upper elastic member region being shaped to at least partially fill the upper cavity region of the respective leg;

wherein:

the upward extending cavity further has a top cavity region that extends upward from the upper cavity region of the respective leg and also extends upward from the upper elastic member region of the elastic member of the respective leg; and the top cavity region is filled with an adhesive that bonds the upper portion of the elastic member to the cavity of the respective leg.

2. The cookware support grate of claim 1, wherein:

the adhesive further fills a space in-between a horizontal outer surface of the upper elastic member region and a horizontal inner wall of the upper cavity region of the respective leg; and the adhesive extends within the cavity no further than the non-circular cavity region of the respective leg.

* * * * *